US005505311A

United States Patent [19]

Kronseder et al.

[11] Patent Number: 5,505,311

[45] Date of Patent: Apr. 9, 1996

[54] APPARATUS FOR REMOVING BOTTLES FROM CONVEYED CONTAINERS

[75] Inventors: Hermann Kronseder, Worth/Donau; Peter Lex, Neutraubling, both of Germany

[73] Assignee: Krones AG Hermann Kronseder Maschinenfabrik, Neutraubling, Germany

[21] Appl. No.: 276,889

[22] Filed: Jul. 19, 1994

[30] Foreign Application Priority Data

Jul. 23, 1993 [DE] Germany ..... 9311046 U

[51] Int. Cl.[6] ..... B07C 5/00

[52] U.S. Cl. ..... 209/522; 209/617

[58] Field of Search ..... 209/522, 523, 209/936, 617

[56] References Cited

U.S. PATENT DOCUMENTS

| | | | |
|---|---|---|---|
| 3,211,290 | 10/1965 | Strickling | 209/522 |
| 3,259,240 | 7/1966 | Schneider | 209/523 |
| 3,656,616 | 4/1972 | Wallington | 209/523 |
| 3,771,649 | 11/1973 | Strauss | 209/522 X |
| 4,239,116 | 12/1980 | Eisenberg et al. | 209/523 |

FOREIGN PATENT DOCUMENTS

2534183C3 12/1981 Germany .

*Primary Examiner*—D. Glenn Dayoan
*Attorney, Agent, or Firm*—Ryan, Maki & Hohenfeldt

[57] ABSTRACT

Containers containing a mixture of acceptable and unacceptable bottles are conveyed to a removal station in the path of movement of a carrier head that has at least one group of gripping elements that are adapted to selectively grip and remove acceptable bottles and at least another group of gripping elements that are adapted to grip and remove unacceptable bottles. In one implementation, the carrier head picks up the acceptable bottles from incoming containers and simultaneously picks up unacceptable bottles from containers from which acceptable bottles have been removed and transfers the respective groups of bottles to individual outfeed conveyors. In another implementation containers holding a mixture of acceptable an unacceptable bottles are conveyed to the removal station on a conveyor having a loop so acceptable bottles are removed from a container at the removal station and the same container containing the remainder of unacceptable bottles goes around the loop and comes back to the removal station in synchronism with infeed containers that contain a mixture of bottles so once the system gets started the gripper carrying head can remove acceptable and unacceptable bottles from adjacent containers with a single traverse by the carrier head.

13 Claims, 6 Drawing Sheets

APPARATUS FOR REMOVING BOTTLES FROM CONVEYED CONTAINERS

BACKGROUND OF THE INVENTION

The invention disclosed herein pertains to apparatus for firstly withdrawing from conveyed containers, such as, boxes, cartons, crates, bottles that are of a specified size and shape so as to be acceptable for being filled in a bottle filling line and secondly to remove unacceptable bottles and convey them to a separate destination.

In beverage bottle refilling lines, there must be a presorting of bottle types so that all bottles that are to be filled are of the same size and shape. Customarily, empty bottles are transported in crates or boxes and are removed and fed to a sorting machine that differentiates acceptable bottles from unacceptable bottles using optical detection systems.

As an advancement to this approach, it has been suggested to sort bottles according to certain features concurrently with their being unpacked or removed from the containers so that a special sorting machine is not required. Up to the present, this objective has been met by feeding individual boxes to a sequence of bottle unpacking machines which each unpack or remove only bottles that have one certain feature such as a specified height to distinguish them while other bottles remain in the box or are grasped only by a following bottle removing or unpacking machine. This arrangement is described in German Patent DE 25 34 183 C3. The arrangement has the disadvantage of requiring several unpacking machines that occupy a substantial amount of floor space.

SUMMARY OF THE INVENTION

According to the invention, a single machine is provided for removing from containers in sequence bottles that are acceptable as to their size and shape for being refilled followed by removing the unacceptable bottles and conveying them to a separate destination apart from the bottle refilling line. The new machine occupies less floor space than the several machines that are required in prior arrangements. High performance unpacking and separation of bottles according to their type is achieved using bottle gripper carrier heads revolving in a closed path. Each carrier head carries a plurality of groups of bottle gripping elements. The elements in at least one group are adapted for gripping only qualified or acceptable bottles and the elements in at least one other group are adapted for gripping unacceptable bottles. The carrier heads can be circulated in a horizontal plane or preferably, a vertical plane so space requirements of the machine are minimized.

Acceptable bottles can be identified by their height, mouth diameter, or shoulder contour, for example, and the bottle gripping elements in a group are specially designed to detect the desired acceptable feature of each bottle in a container and, upon detection of the feature, to automatically trigger a gripping operation so that the acceptable bottle can be lifted out of the container.

Alternatively, however, all groups of gripping elements can be of the same type which are selectively drivable by a detection arrangement arranged stationarily on the infeed side of the container conveyor of the machine.

How the foregoing features and other specific features of the invention are achieved will be evident in the ensuing more detailed description of illustrative embodiments of the invention which will now be set forth in reference to the drawings.

DESCRIPTION OF A PREFERRED EMBODIMENT

Figure 1:
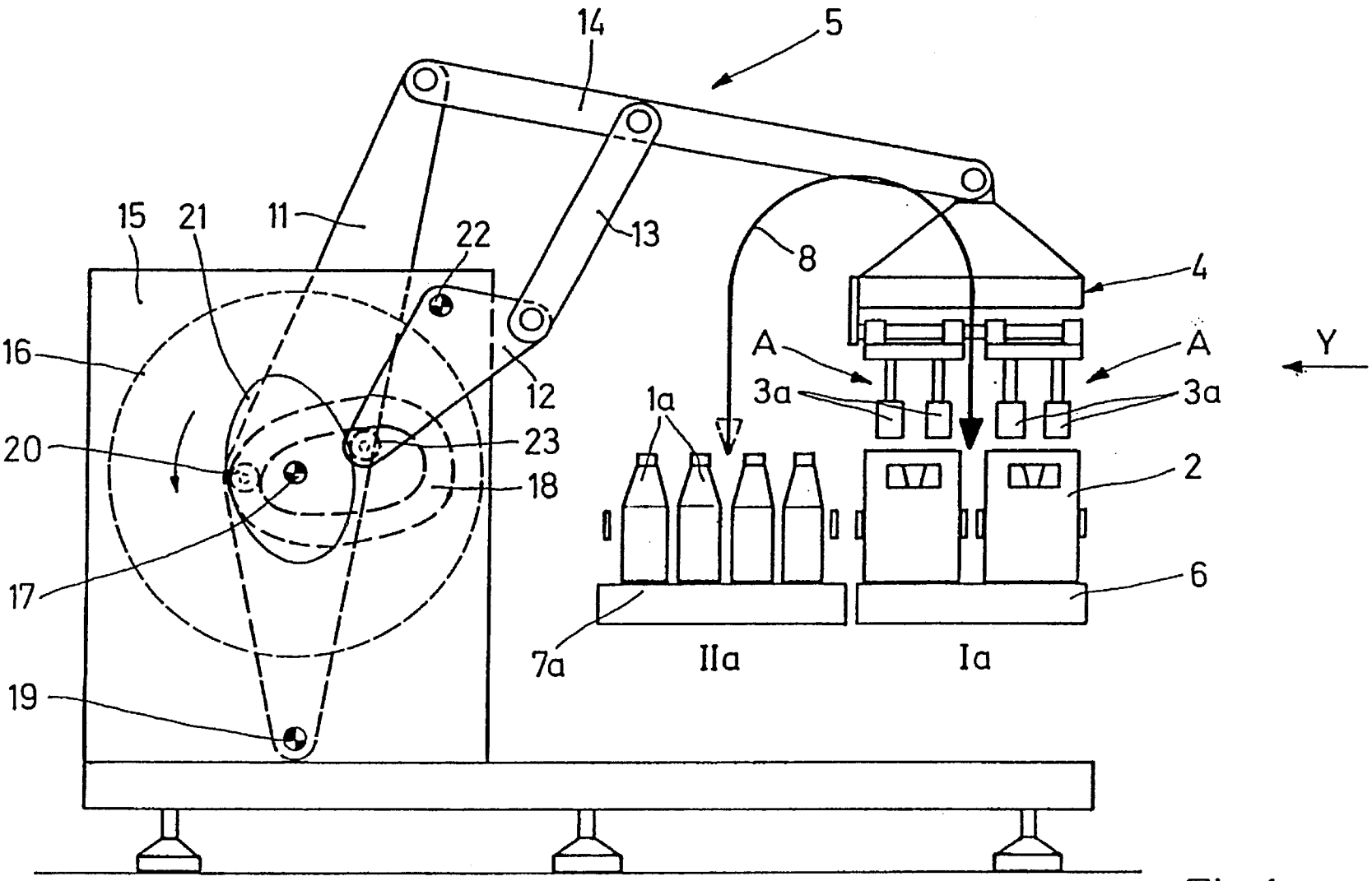
FIG. 1 is a diagrammatic side elevational view of a bottle unpacking machine as viewed in the direction of the arrow Z in FIG. 2.

As shown in FIG. 1, the bottle gripping elements 3, are composed of groups 3*a* and 3*b* of gripping elements are supported in a carrier head 4 which is moved alternately back and forth through the inverted imaginary U-shaped path 8. The driven steering mechanism 5 on which the carrier head 4 is pivotally suspended comprises four articulated levers 11, 12, 13 and 14. The mechanism is supported on a stationary stand plate 15. Lever 11 swings through a limited angle about an axis coincident with the axis of the shaft 19 which pivotally connects lever 11 to stand plate 15. A rotationally driven cam plate 16 turns about the axis of a shaft 17 that is journaled in the plate. Rotating cam plate 16 is provided, on a side away from the viewer in FIG. 1, with a cam groove 18. A cam follower roll 20 that is journaled for rotation on lever 11 is registered in cam groove 18. As the cam groove 18 rotates as a result of rotation of cam plate 16, lever 11 is caused to execute an oscillatory swinging motion about its pivot 19. Another cam plate 21 is fixed on cam plate 16. A cam follower roller 23 on lever 12 follows the contour of cam 21. Lever 12 is pivotally connected by means of a shaft 22 to stand plate 15 so lever 12 can swing through a limited angle about the axis of shaft 22. Main support lever 14, that is pivotally connected to carrier head 4 for supporting the carrier head, is also pivotally connected to lever 13 and to lever 11.

Figure 2:
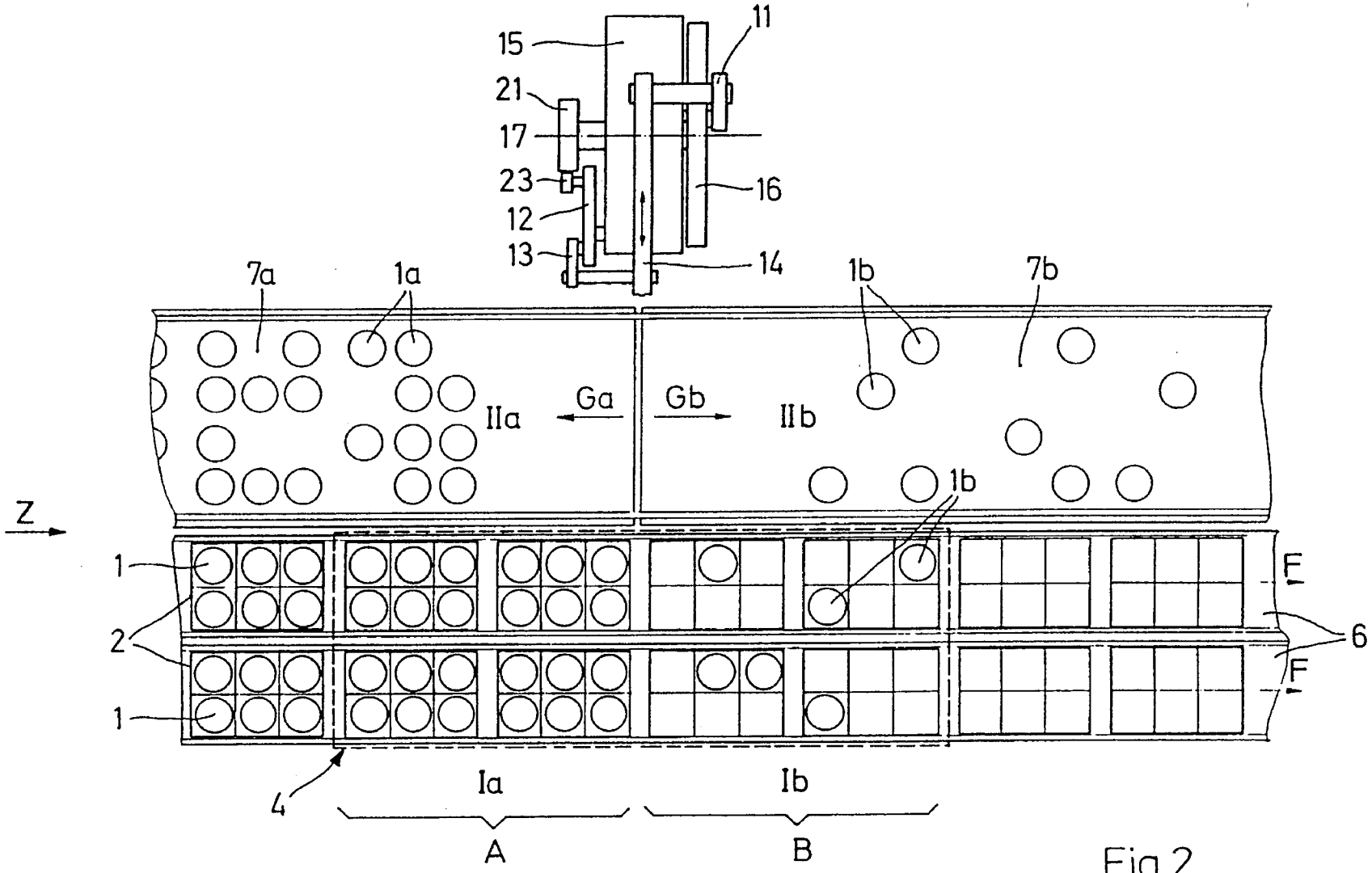
FIG. 2 is a diagrammatic plan view of the unpacking machine depicted in FIG. 1.
Figure 3:
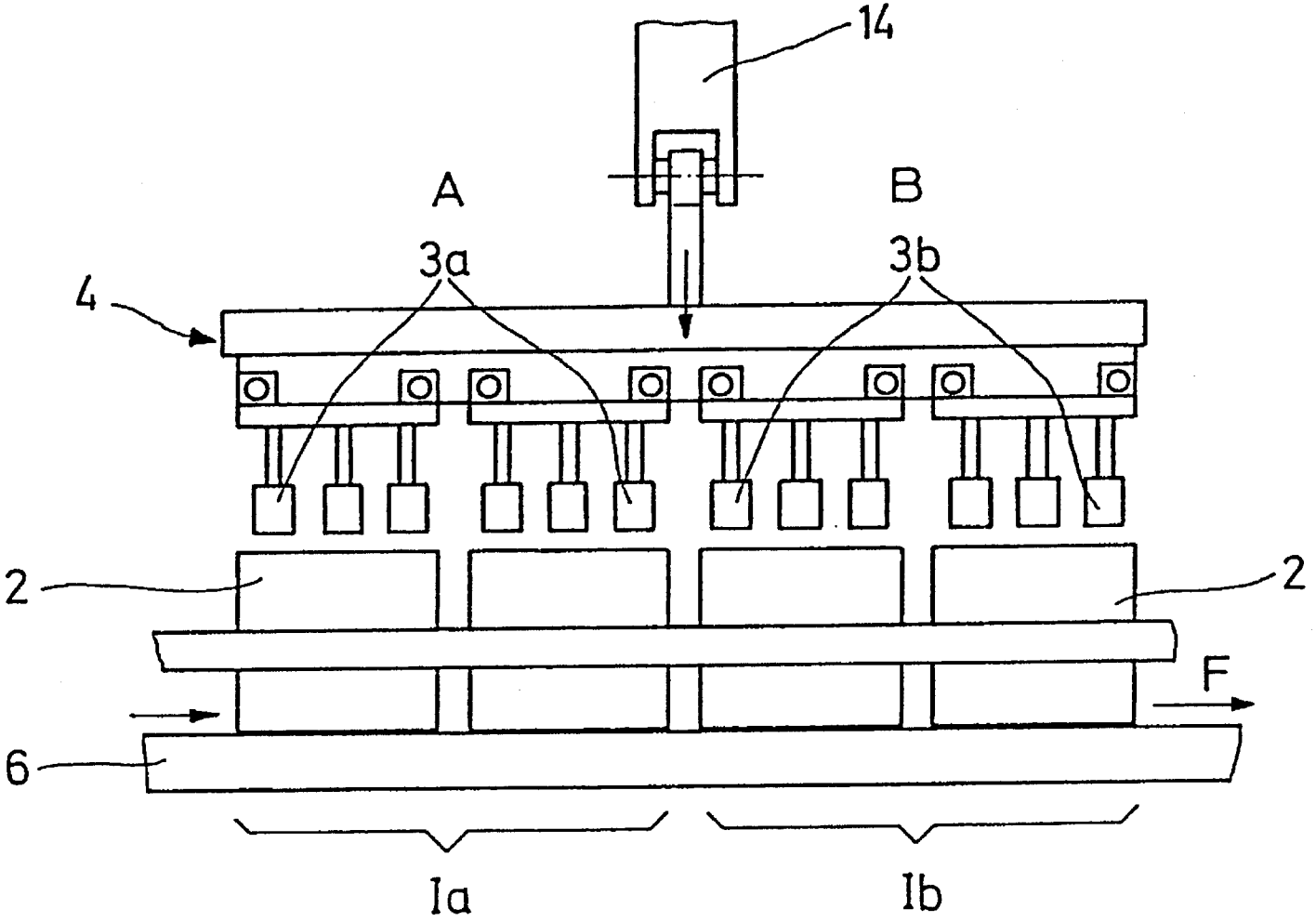
FIG. 3 is a partial diagrammatic elevational view of the unpacking machine as viewed in the direction of the arrow Y in FIG. 1.

The imaginary U-shaped path 8 terminates at one end over infeed conveyor 6 in alignment with bottle removal stations Ia and Ib which is behind Ia as can be confirmed by viewing FIG. 3. The other end of the inverted U-shaped path terminates in a hollow arrow head in the region of vessel receiving stations IIa and IIb, the latter being behind IIa as can be confirmed by viewing FIG. 2. Infeed of containers 2 from which acceptable or qualified bottles are to be removed are conveyed into the apparatus on parallel track infeed conveyor 6. As is especially evident in FIG. 2, for delivery of the bottles Ia and Ib removed from the bottle containers to separate opposite destinations, outfeed conveyors 7*a* and 7*b*, respectively, constituting receiving stations are provided. These conveyors are designated as members of a receiving station to which groups of acceptable and unacceptable bottles, respectively, are to be delivered. The receiving stations are identified as IIa and IIb, generally.

As shown in FIGS. 1 and 2, infeed conveyor 6 has two parallel and integral tracks to provide for feeding two rows of boxes bottle containers 2 simultaneously to the bottle unpacking and separating machine bottle removal station Ia. Feeding two containers 2 concurrently maximizes output of the machine. The machine schematically represented in FIGS. 1, 2 and 3 carries on its carrier head 4 two different groups of gripping elements designated 3*a* and 3*b*. Each of the groups have the same number of gripping elements. Gripping elements 3*a* of one group differ from the gripping elements 3*b* of the other group in that the gripping function of elements 3*a* is triggerable selectively of acceptable bottles from a mixture of acceptable and unacceptable bottles in container 2. That is, only bottles with a certain height are gripped, for example, by gripping elements 3*a*. On the other hand, the group of gripping elements 3*b* of group B are triggered during each operating cycle in order to make it possible to grasp at removal station Ib and deposit at station IIb all the bottles still remaining in the boxes after having passed the group A gripping elements.

A complete unpacking cycle of all bottles 1 present in a container 2 will now be described in reference to FIGS. 1–3. By means of the two parallel tracks on the container infeed conveyor 6, containers 2 containing empty bottles 1 are fed in two parallel rows to the first bottle removing station region Ia. For removing acceptable bottles exhibiting a certain feature, such as a certain height, the infeed conveyor 6 is stopped. The suspension and steering mechanism 5 for the carrier head 4 lowers the carrier head 4 that has the groups of gripping elements 3*a* and 3*b* onto the bottles standing in container 2. All bottles la having a recognizable distinctive feature, for example and not limitation, a specified height automatically trigger gripping elements 3*a* to grip bottles 1*a* and hold them fast. Subsequently, the carrier head 4 is raised by controlled suspension and steering mechanism 5 for the carrier head to traverse the inverted U-shaped path 8 and arrive over the bottle receiving station region IIa. Meanwhile, in proper timing, the infeed conveyor 6 is started again in order to advance the four bottle containers 2 present in the removal station Ia by two box lengths to the second part Ib of the bottle removal station as shown in FIG. 2. Simultaneously, containers 2 filled with a mixture of acceptable and unacceptable bottles are also fed again to the first bottle removal station Ia. As soon as the containers 2 have reached the assigned positions, box conveyor 6 is stopped again. At the same time that this process is in progress, the bottles la held by the gripping elements 3*a* of group A are deposited on the bottle conveyor 7*a* which at this moment is at a standstill. Immediately after the gripping elements 3*a* release and lift off from the acceptable bottle heads, the bottle conveyor 7*a* is set in motion in the direction of the arrow Ga, to feed the bottles 1*a* to a bottle washing machine, not shown, to prepare them for being filled. After the accepted bottles 1*a* are deposited on outfeed conveyor 7*a*, the carrier head 4 is returned by the suspension mechanism 5 transversely to the longitudinally extending box conveyor along inverted U-shaped path 8 to over the bottle removing stations Ia and Ib again whereupon in the region of the bottle removal station Ia acceptable bottles 1*a* are grasped by the gripping elements of group A and simultaneously gripping elements 3*b* of group B are situated in gripping positions so that all bottles 1*b* that have remained in the region of the bottle removal station Ib in the bottle boxes 2 are grasped and deposited on the bottle conveyor 7*b* in the region of the bottle depositing station IIb. Also, the bottle conveyor 7*b* is driven periodically in a conveying direction Gb oppositely of the conveying direction of the bottle conveyor 7*a*. Bottle conveyor 7*b* can convey unacceptable bottles 1*b* to a bottle storage or a collecting container, not shown, for example. It should be understood that when the machine is first started the container infeed conveyor 6 will transport four containers 2 to part Ia of the removal station and conveyor 6 will stop to let the carrier head 4 transfer acceptable bottles by means of gripping elements 3*a* to outfeed conveyor 7*a*. At first cycle or start up there would be no unacceptable bottle containers in removal station part Ib. On the next and ensuing cycles four containers of unacceptable bottles would be advanced to part Ib and carrier head 4 would grip the acceptable bottles at Ia and transfer them to outfeed conveyor 7*a*. At the same time the carrier head would grip the unacceptable bottles at Ib and transfer them to outfeed conveyor 7*b*.

Alternatively to the arrangement depicted in FIGS. 1–3, bottle outfeed conveyors 7*a* and 7*b* can be arranged with their lengths, not shown, transverse to the length of filled container infeed conveyor 6. This is useful especially when more than two groups of different gripping elements are used. In such an arrangement of the bottle and container 2 conveyors, the path of movement of the carrier head 4 can be realized by cam control of the suspension mechanism 5 in such a way that the bottles in the region of the bottle receiving stations IIa and IIb can be deposited on continuously driven conveyor belts. In this case, the carrier head 4 must have a movement vector in the movement direction of the bottle conveying belts 7*a* and 7*b*.

The embodiment represented in FIGS. 1–3 could be further modified in such a way that the gripping elements 3*a* and 3*b* of the respective groups A and B are arranged in two lines adjacent each other on the carrier head 4. Then, the bottle containers 2 are fed at first in one track to a first group of gripping elements that grasp only acceptable bottles which are then conveyed away from the machine and deposited laterally displaced, to the unpacking machine in reverse order to accomplish removal of the bottles that remain in the bottle containers by the second group of gripping elements.

Figure 4:
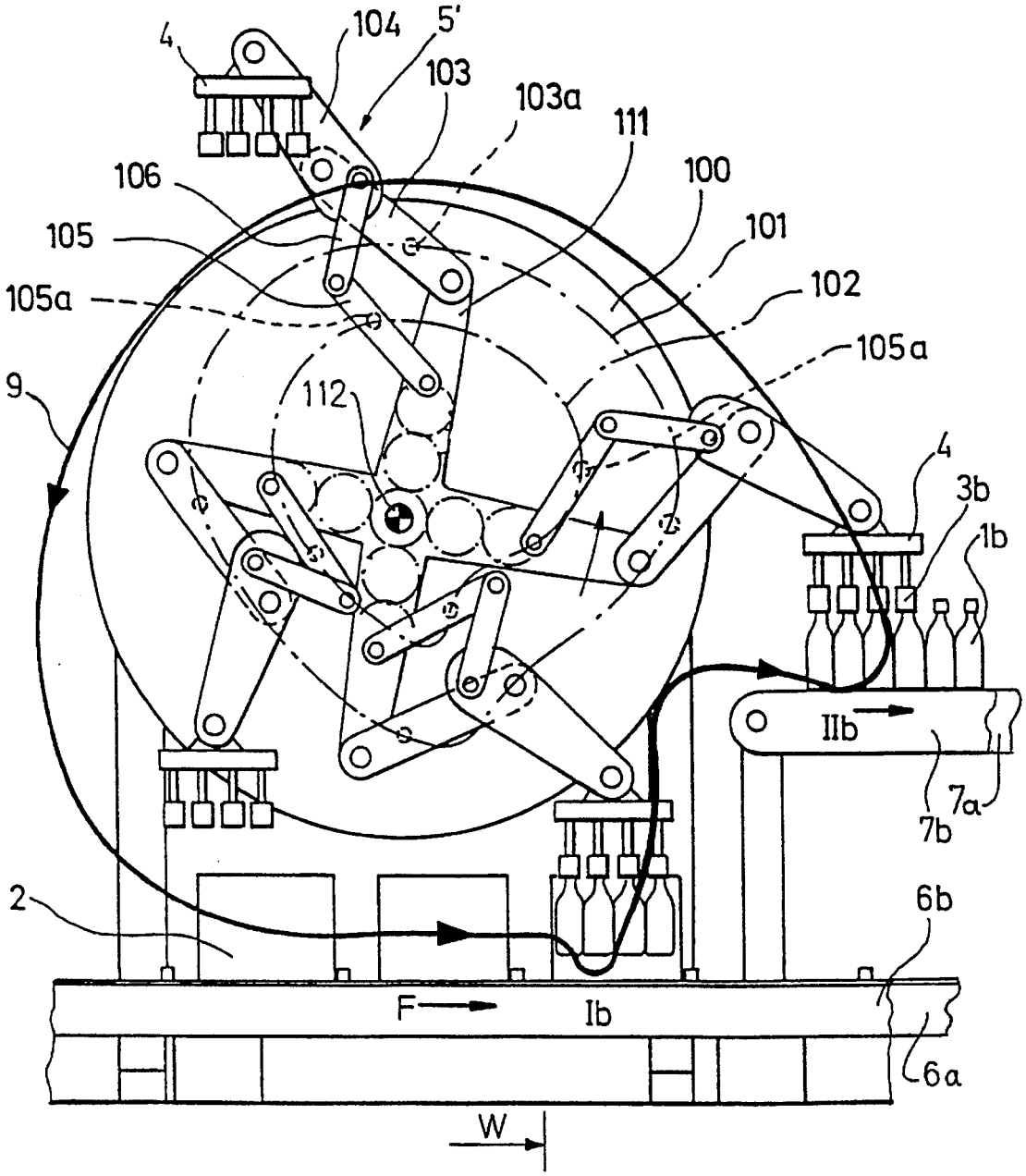
FIG. 4 is a diagrammatic side elevational view of an alternative implementation of the features of the new packing machine as viewed in the direction of the arrow X in FIG. 6.
Figure 5:
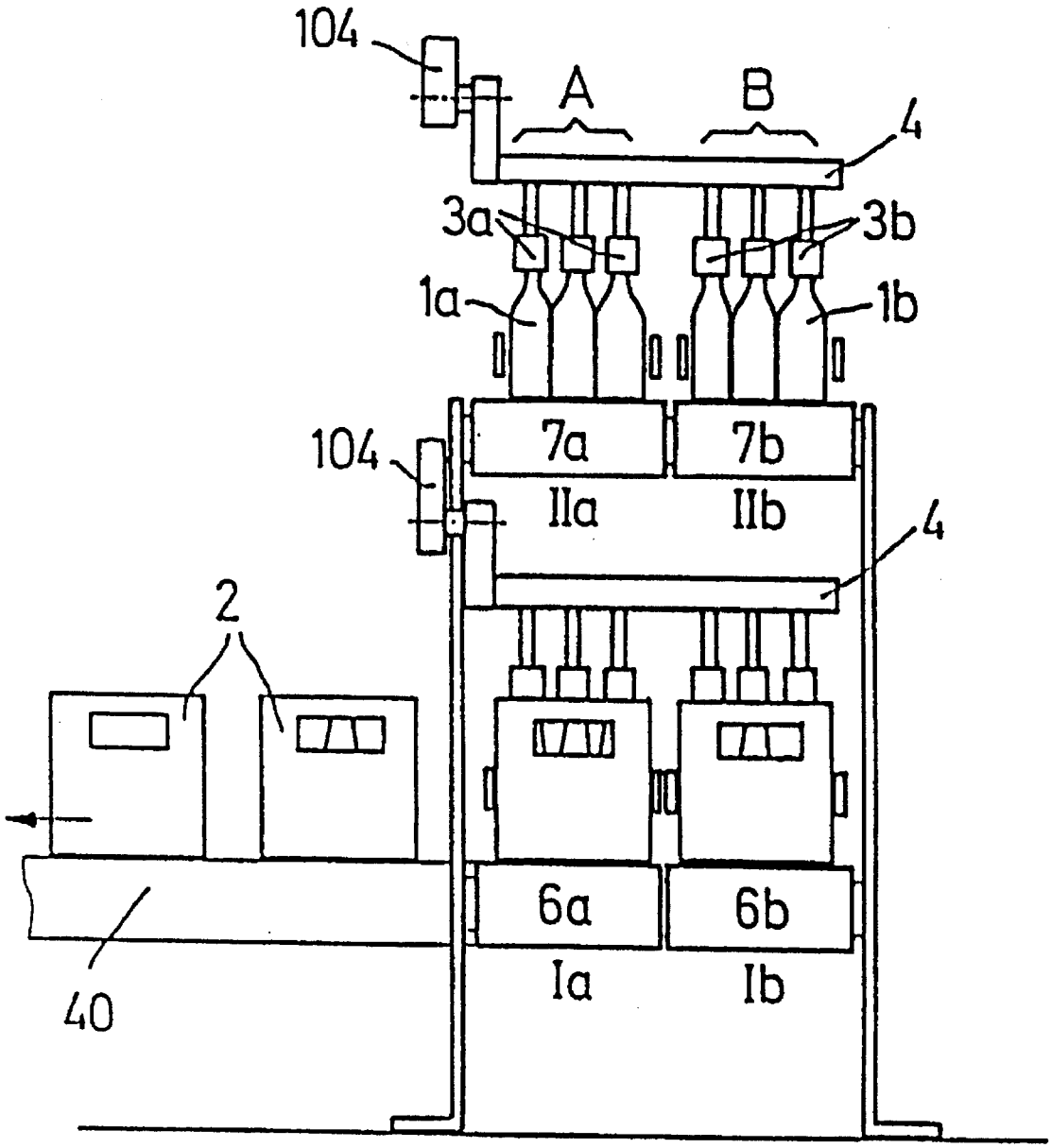
FIG. 5 is a diagrammatic elevational view of the transport conveyor arrangement of the unpacking machine as viewed in the direction of the arrow W in FIG. 4.
Figure 6:
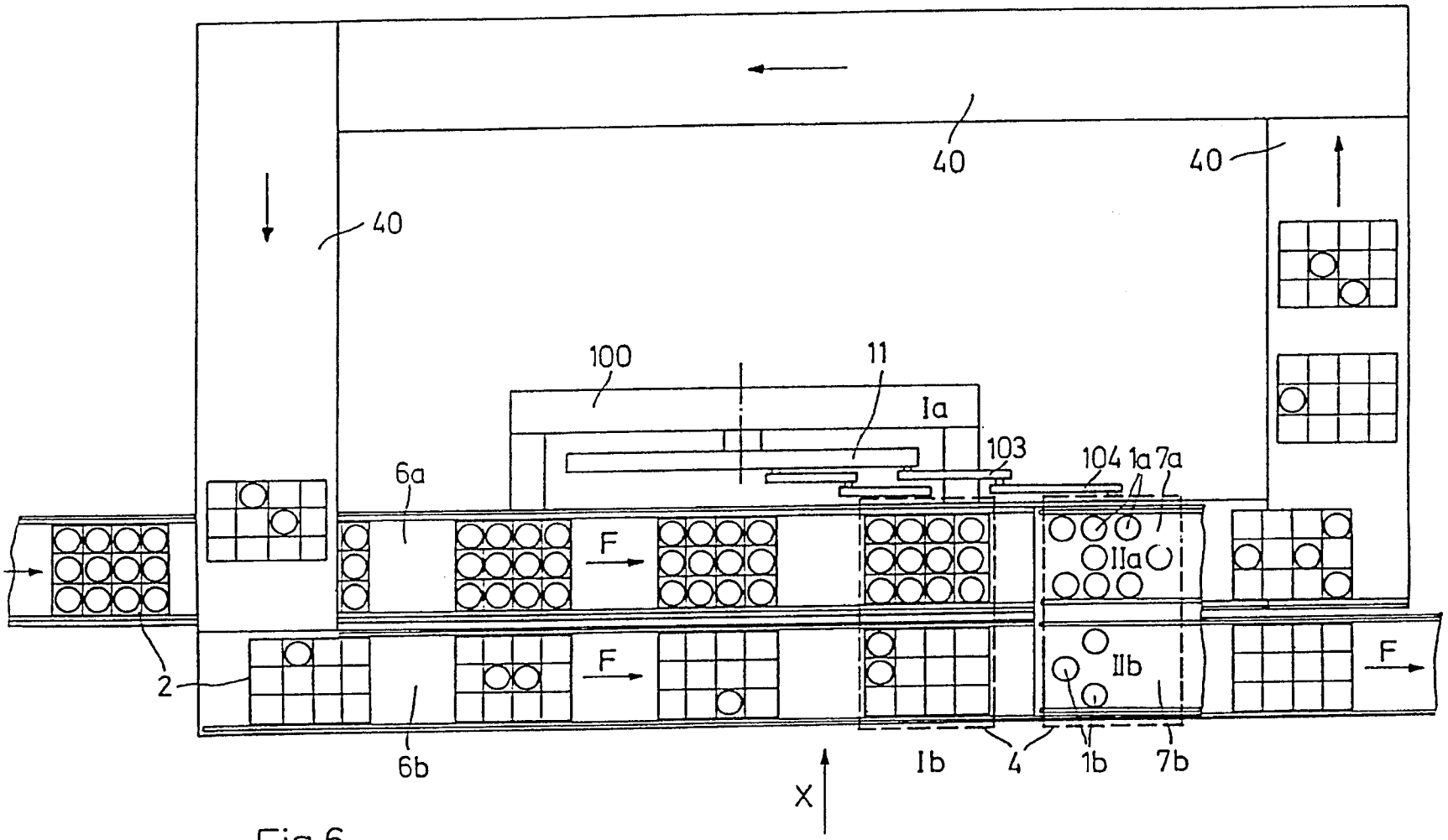
FIG. 6 is a diagrammatic plan view of the new unpacking machine for showing the arrangement of the conveyors represented in the FIG. 4 embodiment.

The basic concepts of the new unpacking machine are implemented in the alternative embodiment depicted in FIGS. 4, 5 and 6. These FIGURES show a continuously operating container unpacking machine having several carrier heads 4 revolving in the same direction in a closed path or loop pattern defined by the arrowheaded line. Each of the carrier heads 4 is pivotally connected to an arm 111 of a four-armed member that is fastened to a shaft 112 which is journaled on a stationary circular plate 100. A lever 104 that is directly linked to the carrier head 4 is also pivotally connected to lever 103 which is pivotally connected to the typical radially extending arm member 111. A lever 106 pivotally connects to lever 104 and a lever 105*a*. Levers 103 and 105 are equipped, respectively, with a cam follower roll 103*a* and 105*a*. The cam grooves in which the follower roll register are outlined in dash-dot lines. Cam follower 105*a* is constrained to follow the closed loop groove 102. Follower roll 103*a* is constrained to follow the closed loop groove 101. The cam grooves required for control of the levers 103 and 105 are milled into the side of a stationary plate 100 facing the arm 111, for instance, as explained, the member having the four arms 111 is driven rotationally relative to plate 100.

As one may see in FIG. 4, the containers 2 are fed by a container conveyor 6 in synchronism with the angular rotation of the carrier head 4 steering rotation mechanism 5'. Above the level of container conveyor 6, a bottle conveyor 7 comprised of 2 lanes or tracks 7*a* or 7*b* are arranged.

Conveyor 7 is driven in phase or synchronously with the revolving carrier head 4 supporting and driving mechanism 5'. The packing machine thus far described in reference to FIG. 4 is basically known from European Patent Disclosure (Offenlegungsschrift) 0 490 084.

The present machine is distinguished from the former machine in that on each of the carrier heads 4 two different groups A and B of gripping elements 3*a* and 3*b* as in FIG. 5 are arranged adjacent each other and transversely of the plane of revolution of the carrier head steering mechanism 5' as can be perceived in FIG. 5. As in the earlier described embodiment of FIGS. 1–3, gripping elements 3*a* in the first group A remove only acceptable bottles that have a certain feature such as a specified bottle height from the bottle containers 2. The acceptable bottles are delivered to conveyor 7*a* which extends over box infeed conveyor track 6*a* receiving station which is shown in FIG. 6. In order to unpack unacceptable bottles 1*b*, if any, still remaining in bottle container 2, the containers transported by conveyor 6*a* pass the first bottle removal station 1*a*, after being acted upon by the gripping elements 3*a* forming the group A, are fed again at the outlet of the machine into a laterally directed container conveying loop 40 in FIG. 6. By making the loop around conveyor 40, bottle containers 2 which have acceptable bottles removed arrive on a container conveyor part 6*b* running parallel to first container infeed conveyor part 6*a*. Container conveying loop 40 crosses the first container infeed conveyor 6*a* with a sufficient elevational clearance. Second conveyor part 6*b* that follows conveyor loop 40 declines in the conveying direction F at such an angle that the bottle containers 2 standing on second container conveyor 6*b* arrive at the removal part station Ib again at the same elevation as the bottles which are conveyed by the first container infeed conveyor part 6*a*. With the aid of the conveying loop 40, the containers 2 containing unacceptable bottles are delivered back to the removing station Ib where they are gripped by gripping elements 3*b* and lifted for being deposited on track 7*b* of the upper level outfeed conveyor 7 at the same time that acceptable bottles are gripped by grippers 3*a* and deposited on track 7*b*. After station IIb the containers 2 from which the unacceptable bottles Ib have been lifted continue empty on lower level conveyor 6*b* for being cleaned and reused. If the unpacking carrier head 4 machine is equipped with more than two different groups of gripping elements, then correspondingly further conveying loops are provided.

Although they are not shown, it will be understood that guide rails are provided along the conveyors that have free standing empty bottles on them although guide rails are not necessary along the bottles that are still in containers 2.

We claim:

1. Apparatus for removing in either order from containers including boxes, cartons and crates, acceptable bottles and unacceptable bottles where the containers may contain a mixture of acceptable and unacceptable bottles, comprising:

a bottle removal station (1*a*,1*b*) at which acceptable bottles and unacceptable bottles are removed from containers, an infeed conveyor for transporting containers to the removal station, a bottle receiving station (11*a*,11*b*) proximate to said removal station for receiving acceptable bottles and unacceptable bottles spaced apart and separated from each other, a carrier head (4), and at least first and second groups of bottle gripping elements mounted to the same carrier head (4), the gripping elements in said first group are adapted for gripping acceptable bottles and the gripping elements in the second group are adapted for gripping unacceptable bottles, a steering mechanism proximate the bottle removal and receiving stations, the mechanism having a support member on which said carrier head is supported, said mechanism including driving components operatively connected to the support member for steering said carrier head in a path wherein said carrier head reaches a position at the removal station over said containers for gripping elements in said first group to grip acceptable bottles that are mixed in containers with unacceptable bottles and for gripping elements in said second group to grip at the same time unacceptable bottles in other containers followed by said carrier continuing along said path to a position over the receiving station where the bottles carried by the second group of gripping elements are released.

2. Apparatus according to claim 1 wherein said infeed conveyor is intermittently driven for transporting containers of bottles to said removal station proximate to the movement path of said carrier head, the first group of gripping elements for gripping acceptable bottles and the second group of gripping elements for gripping unacceptable bottles are arranged in succession in either order on said carrier head in the direction of conveyor movement, said intermittently driven conveyor stopping at said removal station to provide time for the first group of gripping elements to grip acceptable bottles in a container and for the second group of gripping elements to grip unacceptable bottles in a container from which acceptable bottles have been removed and said carrier head continuing along said path of movement for transporting bottles gripped by each group of gripping elements to the receiving station.

3. Apparatus according to claim 2 wherein said receiving station is comprised of individual outfeed conveyors situated near enough to each other for said carrier head to deposit acceptable bottles gripped by one of said first and second groups of gripping elements onto one of the individual conveyors and to deposit unacceptable bottles gripped by the other of said first and second groups of gripping elements onto another of the individual conveyors.

4. Apparatus according to claim 3 wherein said individual outfeed conveyors are arranged parallel to said infeed conveyor and run in directions opposite of each other.

5. Apparatus according to any one of claims 2, 3 or 4 wherein said infeed conveyor has adjacent longitudinally extending tracks and conveys on each of said tracks a plurality of containers from which acceptable bottles have been removed in series with a plurality of containers from which acceptable bottles are to be removed for all of said containers to arrive together at said station, said carrier head carrying a plurality of first groups of gripping elements corresponding in number to the number of containers from which acceptable bottles have been removed and unacceptable bottles remain and another plurality of groups of second gripping elements corresponding in number to the number of containers from which unacceptable bottles are to be removed, the gripping elements of said groups gripping all of the bottles in the plurality of containers simultaneously for transporting acceptable and unacceptable groups of bottles to the receiving station.

6. Apparatus according to any one of claims 1, 2, 3 or 4 where said path in which the carrier head is steered lies in a plane that is transverse to the direction of movement of the infeed conveyor.

7. Apparatus according to claim 1 wherein said infeed conveyor has at least two longitudinally extending tracks for conveying to said removal station containers containing acceptable and unacceptable bottles on each of the tracks adjacent each other for arriving at said removal station together and preceded on said tracks and in said removal station by containers adjacent each other on said tracks from which acceptable bottles have been removed, said carrier head having said first groups of gripping elements arranged for being coincident, respectively, with the containers containing acceptable and unacceptable bottles and said second groups of gripping elements arranged for being coincident, respectively, with the containers from which acceptable bottles have been removed when said carrier head is at the removal station.

8. Apparatus according to claim I wherein said receiving station is comprised of individual outfeed conveyors situated near enough to each other for said carrier head to deposit acceptable bottles gripped at said removal station by said first group of gripping elements onto one of the individual conveyors and to deposit unacceptable bottles gripped by said second group of gripping elements onto another of the outfeed conveyors concurrently, said outfeed conveyors arranged adjacent each other and over at least a part of the infeed conveyor and aligned with said infeed conveyor for transporting acceptable and unacceptable bottles separately of each other away from said removal station, said mechanism steering the carrier head in a closed loop path in a plane that is parallel to the direction of infeed conveyor and outfeed conveyor movement.

9. Apparatus according to claim 1 wherein:

said infeed conveyor is constructed and arranged in the form of a loop that is arranged for transporting containers containing acceptable and unacceptable bottles to said removal station at which acceptable bottles are removed, and said container continuing without the acceptable bottles around the loop to return to the removal station adjacent and synchronized with a container containing acceptable and unacceptable bottles for removal of unacceptable bottles from containers that went around the conveyor loop, said carrier head having a first group of gripping elements thereon positioned for coinciding with the container in the removal station containing acceptable and unacceptable bottles and a second group of gripping elements thereon positioned for coinciding with said adjacent container for unacceptable bottles at the removal station to provide for the respective groups of gripping elements to grip the bottles in the adjacent containers simultaneously followed by steering the carrier head to deliver the bottles to said receiving station.

10. Apparatus according to claim 9 wherein said receiving station is comprised of an outfeed conveyor that receives acceptable bottles and an outfeed conveyor that receives unacceptable bottles, said outfeed conveyors are aligned, respectively, with the infeed conveyor having the container containing acceptable and unacceptable bottles and the infeed conveyor having the container containing unacceptable bottles in the removal station.

11. Apparatus according to claim 9 wherein said outfeed conveyors are positioned at an elevation above the elevation the infeed conveyor has at the removal station.

12. Apparatus according to any one of claims 9 or 10 wherein said steering mechanism comprises a continuously rotatably driven member and a plurality of articulated lever systems coupled to the rotatably driven member at angularly spaced apart places, a carrier head suspended from each lever system and means for controlling the lever systems to direct said carrier heads through a predetermined closed loop path in response to rotation of the said rotatably driven member, each carrier head supporting at least one group of gripping elements for gripping and removing acceptable bottles from a container at the removal station and at least on group of gripping elements for gripping and removing unacceptable bottles from a container concurrently at said removal station.

13. Apparatus according to claim 11 wherein said closed loop path lies in a vertical plane.

* * * * *